US008984917B2

(12) United States Patent
Kim et al.

(10) Patent No.: US 8,984,917 B2
(45) Date of Patent: Mar. 24, 2015

(54) WASHING MACHINE

(75) Inventors: Seong Hyeon Kim, Seoul (KR); Kyung Seop Hong, Seoul (KR); Jae Won Chang, Seoul (KR); Seung Chul Park, Seoul (KR)

(73) Assignee: LG Electronics Inc., Seoul (KR)

( * ) Notice: Subject to any disclaimer, the term of this patent is extended or adjusted under 35 U.S.C. 154(b) by 1382 days.

(21) Appl. No.: 12/388,299

(22) Filed: Feb. 18, 2009

(65) Prior Publication Data

US 2009/0211310 A1 Aug. 27, 2009

(30) Foreign Application Priority Data

Feb. 19, 2008 (KR) ..... 10-2008-0014973

(51) Int. Cl.
*D06F 37/20* (2006.01)
*D06F 37/30* (2006.01)

(52) U.S. Cl.
CPC ..... *D06F 37/206* (2013.01); *D06F 37/304* (2013.01)
USPC ..... 68/23.1; 68/3 R; 68/12.24; 68/140

(58) Field of Classification Search
CPC ..... D06F 37/304; D06F 37/206
USPC ..... 68/3 R, 12.24, 23.1, 24, 140
See application file for complete search history.

(56) References Cited

U.S. PATENT DOCUMENTS

| | | | | |
|---|---|---|---|---|
| 6,460,382 | B1 * | 10/2002 | Kim et al. | 68/140 |
| 6,474,114 | B1 * | 11/2002 | Ito et al. | 68/140 |
| 6,510,716 | B1 * | 1/2003 | Kim et al. | 68/24 |
| 6,564,594 | B1 * | 5/2003 | Ito et al. | 68/24 |
| 2004/0163428 | A1 * | 8/2004 | Kim et al. | 68/140 |
| 2005/0194859 | A1 * | 9/2005 | Lee | 310/216 |
| 2006/0096329 | A1 | 5/2006 | Kim et al. | |
| 2006/0096330 | A1 * | 5/2006 | Kim et al. | 68/3 R |
| 2006/0101866 | A1 * | 5/2006 | Kim et al. | 68/3 R |
| 2006/0101872 | A1 * | 5/2006 | Kim et al. | 68/139 |
| 2006/0191301 | A1 * | 8/2006 | Park et al. | 68/140 |
| 2006/0191302 | A1 * | 8/2006 | Kim et al. | 68/140 |
| 2006/0196233 | A1 * | 9/2006 | Kim et al. | 68/140 |
| 2007/0074543 | A1 * | 4/2007 | Lim et al. | 68/140 |

FOREIGN PATENT DOCUMENTS

| | | | |
|---|---|---|---|
| EP | 1 428 924 | A1 | 6/2004 |
| EP | 1 602 768 | A2 | 12/2005 |
| JP | 2007-252940 | A | 10/2007 |
| JP | 4455988 | B2 | 2/2010 |
| KR | 10-0651980 | B1 | 11/2006 |
| KR | 10-0664070 | B1 | 12/2006 |

* cited by examiner

*Primary Examiner* — Michael Barr
*Assistant Examiner* — Benjamin L Osterhout
(74) *Attorney, Agent, or Firm* — Birch, Stewart, Kolasch & Birch, LLP

(57) ABSTRACT

A washing machine in accordance with the present invention includes a mounting member disposed between a stator and a bearing housing. Thus, when a motor is rotated according to an operation of the washing machine, the transmission of vibration, which is generated by a repulsive force of the stator, to the bearing housing can be reduced efficiently. Accordingly, a tub coupled to the bearing housing can be prevented from vibrating due to the vibration of the stator, and noise due to the vibration of the tub can be reduced.

19 Claims, 14 Drawing Sheets

WASHING MACHINE

This application claims the benefit of Korean Patent Application No. 10-2008-0014973, filed on Feb. 19, 2008 which is hereby incorporated by reference for all purposes as if fully set forth herein.

BACKGROUND OF THE INVENTION

1. Field of the Invention

The present invention relates to a washing machine, and more particularly, to a washing machine which can reduce the transmission of vibration of a stator to a tub.

2. Discussion of the Related Art

The drum of a washing machine treats the laundry using rotatory power generated by a motor. A stator of the motor is directly coupled to a tub, so vibration of the stator is transferred to the tub. When the washing machine is operated, noise is generated due to the vibration. In particular, the conventional washing machine is problematic in that the vibration is not reduced effectively because the stator is directly coupled to a bearing housing that is inserted into the tub and fixed thereto.

SUMMARY OF THE INVENTION

Accordingly, the present invention is directed to provide a washing machine which can reduce noise generating from a tub due to vibration of a stator transferred to the tub.

A washing machine according to an aspect of the present invention includes a motor including a stator and a rotor, a drum driven by a rotation shaft of the rotor, a tub defining a space where the drum is positioned, a bearing housing fixed to the tub and accommodating bearings therein, the bearings supporting the rotation shaft of the rotor, and a mounting member disposed between the stator and the bearing housing and coupled to the bearing housing and the stator, the mounting member functioning to reduce vibration transferred from the stator to the tub.

Further, the present invention may include stator couplers and bearing couplers. The stator couplers may be bent and formed from the bearing couplers.

A washing machine according to another aspect of the present invention includes a motor including a stator and a rotor, a drum driven by a rotation shaft of the rotor, a tub defining a space where the drum is positioned, a bearing housing fixed to the tub and accommodating bearings therein, the bearings supporting the rotation shaft of the rotor, and a mounting member disposed between the stator and the bearing housing, wherein the mounting member is deformed by a load of the stator.

A washing machine according to still another aspect of the present invention includes a motor including a stator and a rotor, a drum driven by a rotation shaft of the rotor, a tub defining a space where the drum is positioned, a bearing housing fixed to the tub and accommodating bearings therein, the bearings supporting the rotation shaft of the rotor, and a mounting member disposed between the stator and the bearing housing and coupled to the bearing housing and the stator, respectively.

The present invention further relates to the washing machine including the mounting member, which is disposed between the stator and the bearing housing and configured to reduce vibration occurring from a motor. Accordingly, transmission of vibration occurring due to a direct coupling of the motor to the bearing housing can be effectively prevented. Further, since the vibration is reduced, the occurrence of noise can be prevented.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE INVENTION

The present invention will now be described in detail in connection with specific embodiments with reference to the accompanying drawings.

Figure 1:
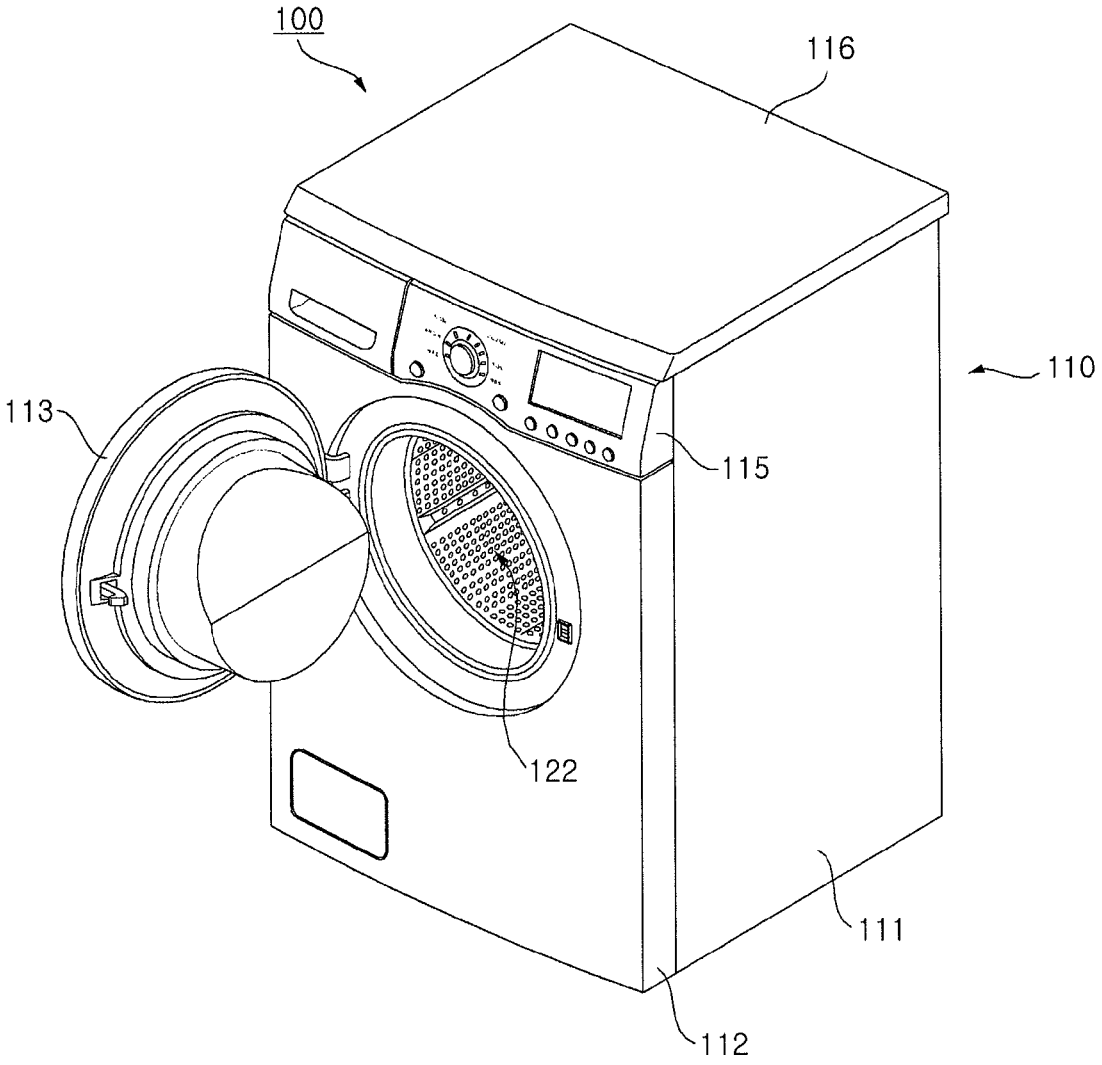
FIG. 1 is a perspective view illustrating an embodiment of a washing machine in accordance with the present invention.
Figure 2:
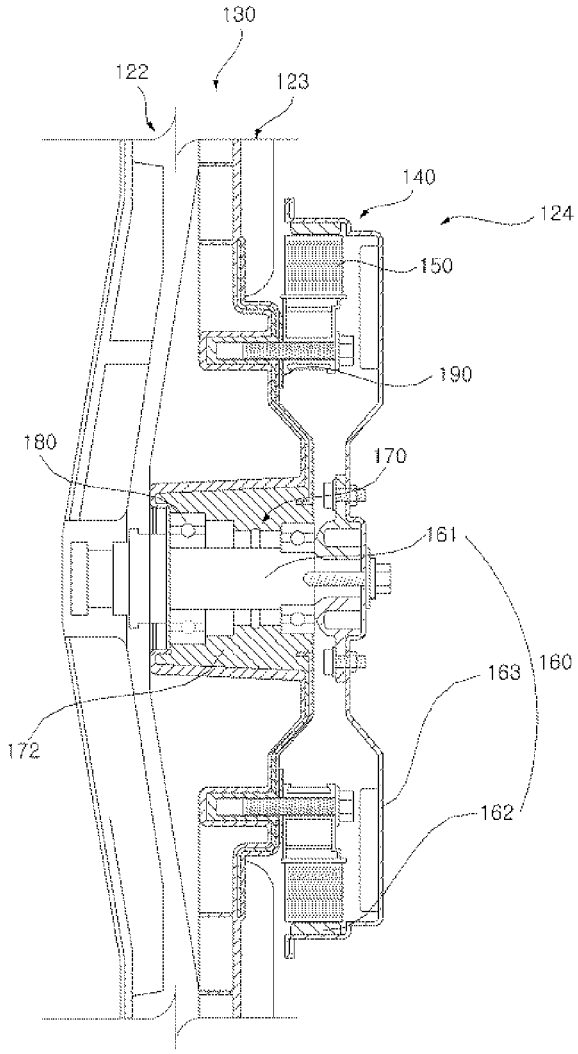
FIG. 2 is a partial sectional view showing a laundry-washing unit of the washing machine shown in FIG. 1.
Figure 3:
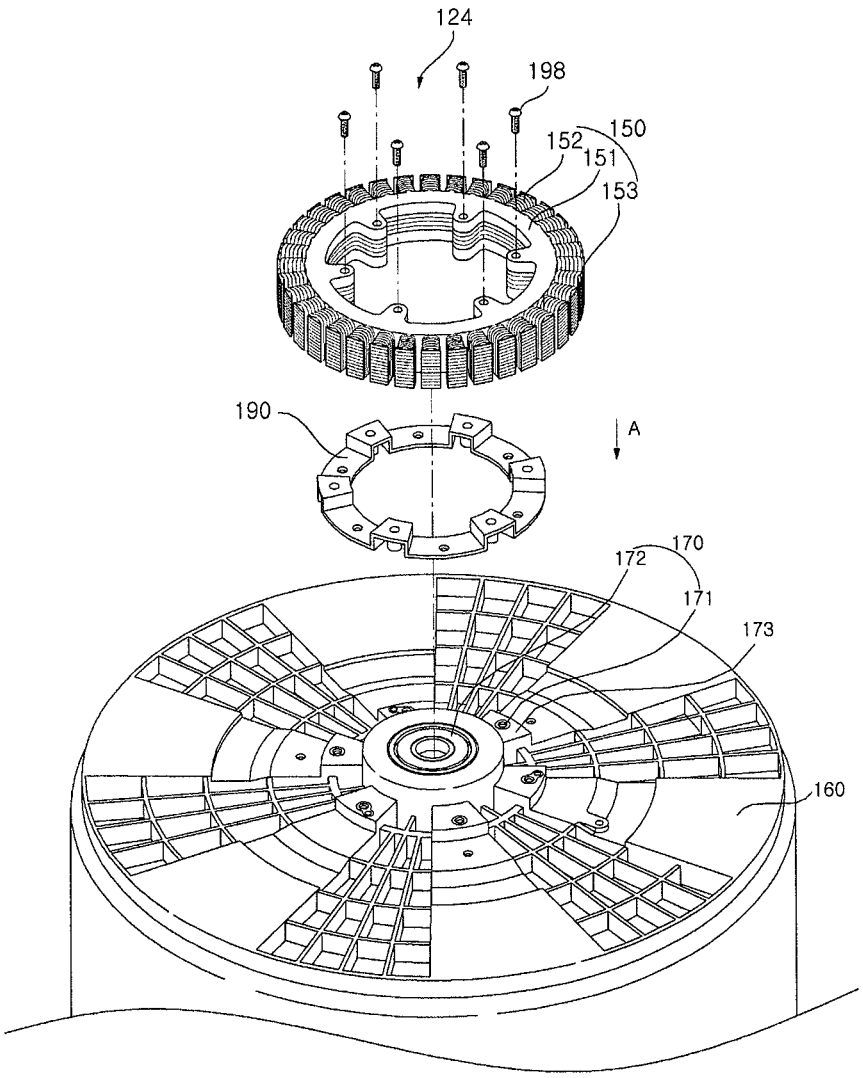
FIG. 3 is a perspective view showing an assembly sequence of the laundry-washing unit shown in FIG. 2.
Figure 4:
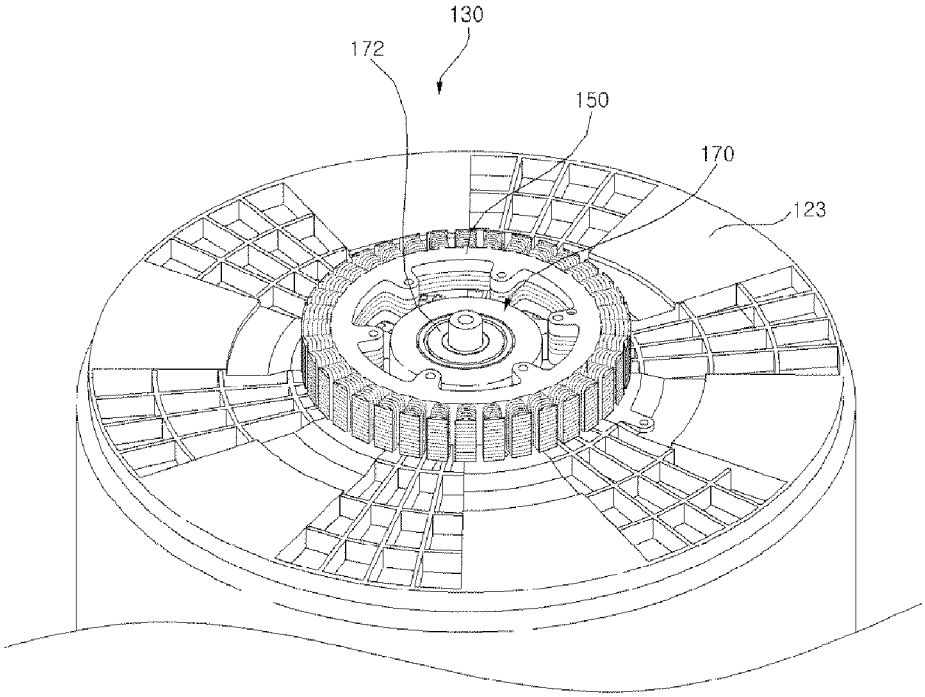
FIG. 4 shows an assembly of the laundry-washing unit shown in FIG. 3.

FIG. 1 is a perspective view illustrating an embodiment of a washing machine 100 in accordance with the present invention. FIG. 2 is a partial sectional view showing a laundry-washing unit 130 of the washing machine 100 shown in FIG. 1. FIG. 3 is a perspective view showing an assembly sequence of the laundry-washing unit 130 shown in FIG. 2. FIG. 4 shows an assembly of the laundry-washing unit 130 shown in FIG. 3.

Referring to FIG. 1, the washing machine 100 includes a cabinet 110, a laundry-washing unit (not shown) which is disposed within the cabinet 110 and in which the laundry is washed, a washing water supplier (not shown) that introduces washing water to the laundry-washing unit, and a discharge unit (not shown) that discharges washing water after washing in the laundry-washing unit to the outside.

The cabinet 110 includes a cabinet main body 111, a cabinet cover 112 disposed at the front of the cabinet main body 111 and coupled thereto, a control panel 115 disposed on one side of the cabinet cover and configured to control an operating state of the washing machine 100, and a top plate 116 disposed on an upper side of the control panel 115 and coupled to the cabinet main body 111. The cabinet cover 112 includes a laundry input/outlet opening for inserting the laundry into a drum 122, and a door 113 rotatably coupled to the cabinet cover 112 so that it opens and closes the laundry input/outlet opening.

Referring to FIG. 2, the laundry-washing unit 130 includes the drum 122 into which the laundry is inserted and in which washing is performed, a tub 123 defining a space where the drum 122 is disposed, and a driving unit 124 that generates driving force for transferring rotatory power to the drum 122. The driving unit 124 includes a driver portion 135 that generates driving force, bearings 180, and a bearing housing 170 that supports the bearings 180. The bearings 180 are inserted into and disposed in the bearing housing 170.

The driver portion 135 provides means for transferring driving force to the drum 122 and can be selected in various ways. Hereinafter, an embodiment in which a motor 140 is used as the driver portion 135 is described. The motor 140 includes a stator 150 and a rotor 160. The rotor 160 generates driving force using electromagnetic force generated between the stator 150 and the rotor 160. The rotor 160 includes a rotor frame 163, a rotor magnet 162, and a rotation shaft 161. The rotor frame 163 is disposed to surround an outer side of the stator 150. The rotor magnet 162 is disposed within an inner circumference of the rotor frame 163 and is rotated according to electric force generated from the stator 150. The rotation shaft 161 transmits rotatory power, which is generated when the rotor magnet 162 rotates, to the drum 122.

Referring to FIGS. 3 and 4, the stator 150 includes a clamping hole 151 fixed to a mounting member 190, a coil portion 152 that generates electromagnetic force, and a body portion 153 that fixes the coil portion 152. The bearing housing 170 includes a bearing support 172 and a stator clamping portion 173. The bearing support 172 is insert-molded into a rear wall portion of the tub 123 and functions to support the bearings 180. The stator clamping portion 173 extends in a radial direction from the bearing support 172 and is coupled to the stator 150.

The stator clamping portion 173 includes mounting member clamping holes 171 coupled to a mounting member 190. The mounting member 190 includes a plurality of bearing couplers 194 and a plurality of stator couplers 191 (refer to FIG. 5). The bearing couplers 194 are coupled to the bearing housing 170. The stator couplers 191 are disposed between the bearing couplers 194 and function to connect the bearing couplers 194 and fix the stator 150 and reduce vibration transferred from the stator 150 to the tub 123.

The bearing housing 170 is fixed to the tub 123. A method of fixing the bearing housing 170 to the tub 123 may be various. In the present invention, an embodiment in which the bearing housing 170 is inserted into the tub 123 is described as an embodiment. However, it is to be understood that the following description is only an embodiment and the present invention is not limited thereto.

The mounting member clamping holes 171 of the bearing housing 170 are exposed outside the tub 123. The bearing support 172 of the bearing housing 170 is also exposed outside the tub 123. The mounting member 190 is coupled to the bearing housing 170 in the direction of A (refer to FIG. 3). The bearing couplers 194 of the mounting member 190 are disposed on an outer side of the tub 123 and are fastened by the mounting member clamping holes 171 and fastening members 198. When the mounting member 190 is fastened to the bearing housing 170, the stator 150 is coupled to the mounting member 190 in the direction of A. The stator 150 is coupled to the stator couplers 191 in the direction of A and then fixed by the fastening members 198.

Figure 5:
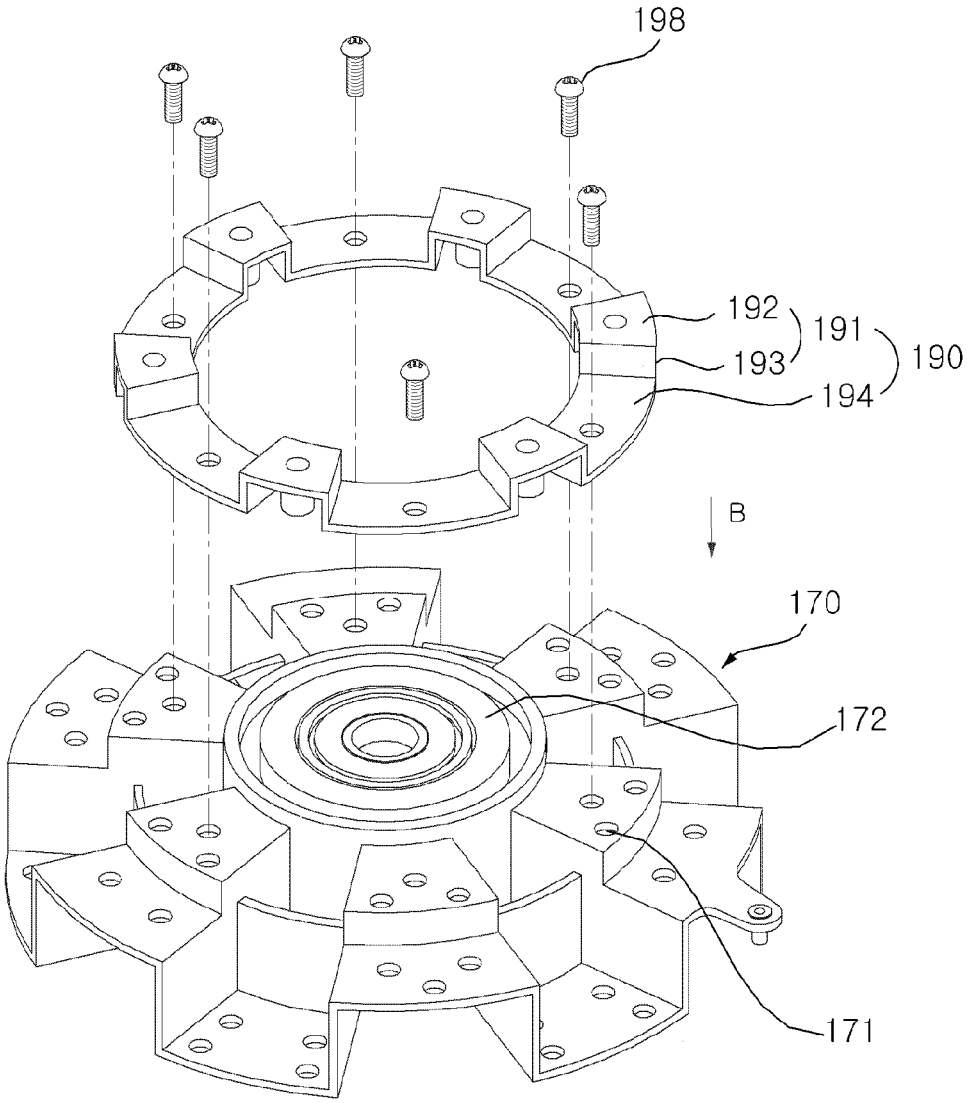
FIG. 5 is a perspective view showing an assembly sequence of a driving unit shown in FIG. 4.
Figure 6:
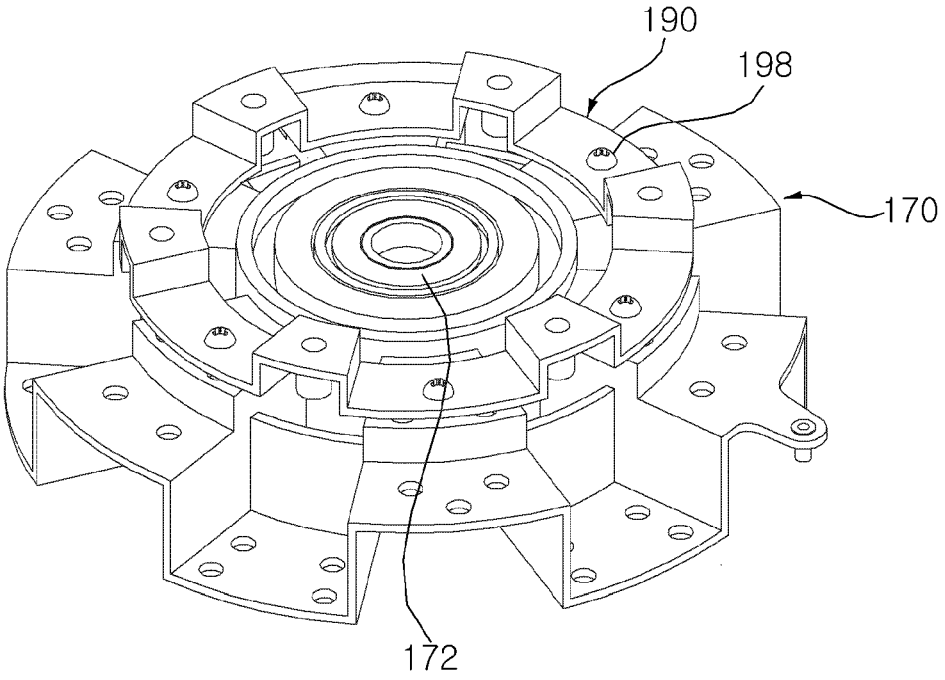
FIG. 6 is a detailed perspective view of the driving unit shown in FIG. 5.
Figure 7:
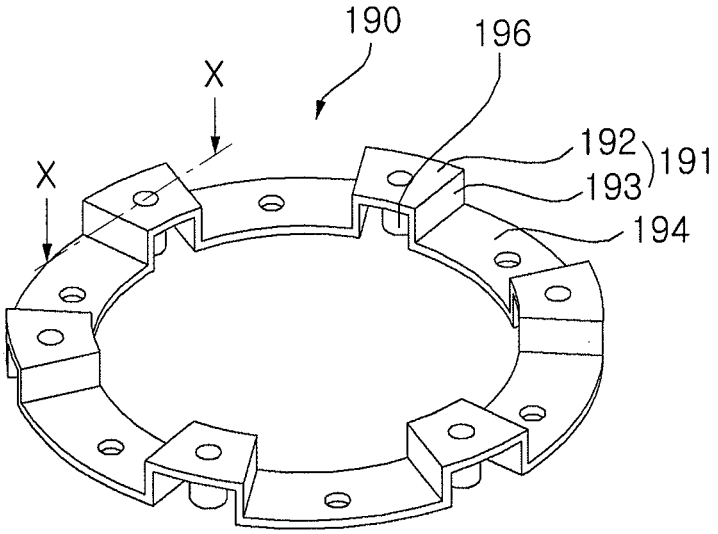
FIG. 7 is a perspective view illustrating an embodiment of a mounting member shown in FIG. 6.

FIG. 5 is a perspective view showing an assembly sequence of the driving unit 124 shown in FIG. 4. FIG. 6 is a detailed perspective view of the driving unit 124 shown in FIG. 5. FIG. 7 is a perspective view illustrating an embodiment of the mounting member 190 shown in FIG. 6.

Referring to FIGS. 5 and 6, the bearing housing 170 is inserted into the tub (not shown) and fixed thereto. FIG. 5 illustrates a state in which the bearing housing 170 and the mounting member 190 are being assembled with the tub being omitted. The bearing housing 170 is coupled to the mounting member 190 in the direction of B. The bearing housing 170 is coupled to the mounting member 190 through the plurality of mounting member clamping holes 171 formed on one side of the bearing housing 170. The bearing couplers 194 are formed on one side of the mounting member 190 such that they are coupled to the mounting member clamping holes 171. The mounting member clamping holes 171 are coupled to the bearing couplers 194, respectively, and fixed thereto by the fastening members 198.

Meanwhile, the stator (not shown) is coupled to the stator couplers 191 formed on one side of the mounting member 190 and fixed thereto. The stator 150 is coupled to the mounting member 190 by the fastening members 198 in the direction of B. Accordingly, in the washing machine 100 of the present invention, the motor 140 is not directly coupled to the tub 123, but coupled to the tub 123 through the mounting member 190. That is, the mounting member 190 is disposed (sandwiched) between the motor 140 and the tub 123 and supports the motor 140.

Referring to FIG. 7, the mounting member 190 includes the plurality of bearing couplers 194 and the plurality of stator couplers 191 disposed between the plurality of bearing couplers 194. The bearing couplers 194 are coupled to the bearing housing 170. The stator couplers 191 connect to the plurality of bearing couplers 194 and are fixed to the stator 150. Each of the stator couplers 191 includes a stator clamping portion 192 coupled to the stator, and a connecting portion 193 extending from the stator clamping portion 192. The connecting portion 193 is coupled to the bearing coupler 194. The connecting portion 193 is bent and extends from the stator clamping portion 192 and is then coupled to the bearing coupler 194. That is, the connecting portion 193 is bent from the stator clamping portion 192 and couples the stator clamping portion 192 to the bearing coupler 194. Meanwhile, each bearing coupler 194 is coupled to each stator coupler 191 while forming a specific angle with respect to the stator coupler 191. The specific angle may be substantially a right angle.

The bearing couplers 194 are disposed on a plane different from that of the stator clamping portions 192. In other words, the bearing couplers 194 are lower in height than the stator clamping portions 192. The bearing couplers 194 are disposed on a plane higher than that of the stator clamping portions 192. As described above, since the bearing couplers 194 are disposed on a plane different from that of the stator clamping portions 192, vibration can be effectively reduced. The bearing coupler 194 can be coupled to each stator clamping portion 192 while forming a specific angle with respect to the connection portion 193. The bearing coupler 194 is substantially at right angles to the connection portion 193. The specific angle is not limited to the right angle and may include all angles which can reduce vibration generated from the stator according to experiments, etc.

Clamping holes (not shown) of the bearing couplers 194 are arranged in a first cylindrical direction. Clamping holes (not shown) of the stator couplers 191 are arranged in a second cylindrical direction between the bearing couplers 194. The first cylindrical direction may be substantially the same as the second cylindrical direction. If the first cylindrical direction is identical to the second cylindrical direction as described above, eccentricity of the mounting member 190 due to vibration of the stator can be prevented, so the vibration can be distributed effectively. Hence, the vibration of the stator can be decreased efficiently. Since the vibration is distributed effectively, the malfunction of the washing machine 100 due to breakage, etc. of the mounting member 190 can be prevented.

Figure 8:
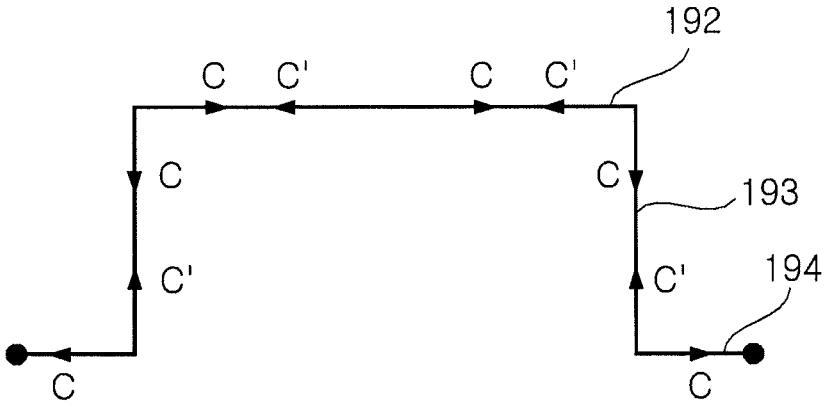
FIG. 8 is a conceptual view illustrating an embodiment of vibration of the mounting member shown in FIG. 7.

FIG. 8 is a conceptual view illustrating an embodiment of vibration of the mounting member 190 shown in FIG. 7.

Referring to FIG. 8, when the washing machine 100 is operated, the motor (not shown) is driven. When the motor is driven, current is applied to a coil portion (not shown) of the stator (not shown). The stator generates electric force using the applied current. The magnet is rotated by magnetic force generated from the magnet disposed outside the stator, which rotates the rotation shaft (not shown). When the rotation shaft rotates, the drum is rotated by rotatory power of the rotation shaft. Meanwhile, when the motor is driven, vibration is generated by repulsive force of the stator. The vibration is transmitted to the stator, which is therefore vibrated. The vibration of the stator is transmitted to the tub.

Meanwhile, the conventional coupling of the stator and the tub is described below. The conventional stator is directly coupled to the tub. Hence, when the conventional stator vibrates, the vibration is transferred to the tub through the connection between the conventional stator and the tub. The transferred vibration causes the tub to vibrate, thus generating noise.

However, the stator in accordance with an embodiment of the present invention is not directly coupled to the tub, but coupled to the tub via the mounting member 190. The mounting member 190 is coupled to the bearing housing (not shown) through the bearing coupler 194. The mounting member 190 is coupled to the stator through the stator couplers 191. The stator couplers 192 can include bosses 196 (refer to FIG. 7) into which bolts are inserted so that the stator is coupled to the bosses 196. The bosses 196 extend up to the same plane as that of the bearing couplers 194 from the stator couplers 192.

When the stator is coupled to the bosses 196 and fixed thereto, vibration generated from the stator is transferred to the bosses 196. The transferred vibration is transferred to the stator clamping portions 192 through the bosses 196. The vibration is then transferred from the stator clamping portions 192 to the connecting portions 193. The vibration is then transferred to the bearing couplers 194 through the connecting portions 193. The transferred vibration is finally transferred to the bearing housing and the tub coupled to the bearing couplers 194 and the fastening members (not shown). The vibration causes the tub to be vibrated.

Meanwhile, the connecting portions 193 extend from the stator clamping portions 192 and are then coupled to the bearing couplers 194. The connecting portions 193 are bent and coupled to the stator clamping portions 192 and the bearing couplers 194. Hence, vibration travels in the direction of C and then collides against the bent portions of the connecting portions 193. The bent portions cause reflected wave of the vibration, which travels in the direction of C, to travel in the direction of C'. Transmission power of the vibration in the direction of C is lowered by the reflected wave of the direction C', thus weakening the vibration. The intensity of the vibration with the lowered transmission power, which is transferred to the tub, is significantly reduced.

Figure 9:
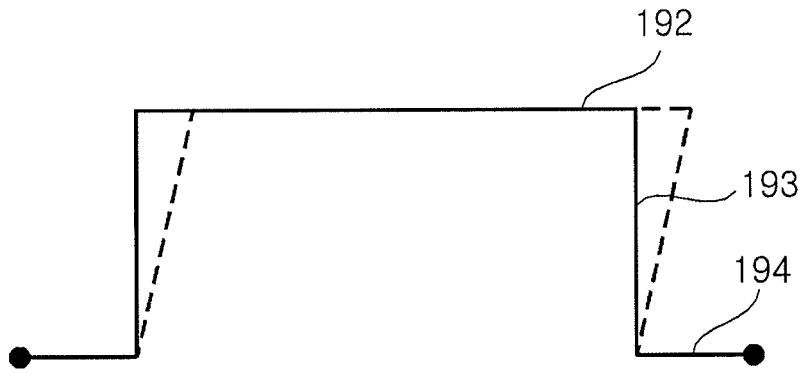
FIG. 9 is a conceptual view illustrating another embodiment of vibration of the mounting member shown in FIG. 7.

FIG. 9 is a conceptual view illustrating another embodiment of vibration of the mounting member 190 shown in FIG. 7. The same reference numbers as those of the above embodiment will be used to refer to the same parts. Differences between the above embodiment and the present embodiment are mainly described below.

Referring to FIG. 9, the mounting member 190 includes the plurality of bearing couplers 194 and the stator couplers 191 disposed between the bearing couplers 194. The bearing couplers 194 are coupled to the bearing housing 170. The stator couplers 191 connect the bearing couplers 194 and fix the stator. When vibration is generated in the motor, it is transferred to the stator. The transferred vibration is transferred to the mounting member 190. The vibration transferred to the mounting member 190 causes the bearing couplers 194 to vibrate.

In other words, when the stator vibrates, the stator couplers 191 are also vibrated by the vibration of the stator. This vibration is vibrated on the basis of the plurality of bearing couplers 194, that is, in the direction of the vibration. While the vibration is in progress, the stator couplers 191 generate a restoring force similarly to a sheet spring, thus reducing the vibration.

Further, while vibrating, the stator couplers 191 consume vibration energy through friction with the air. The vibration that should be transferred to the tub is converted into vibration energy of the stator couplers 191 due to the vibration of the stator couplers 191, so the vibration is not transferred to the tub. Accordingly, vibration transferred to the bearing couplers 194 is reduced significantly.

Figure 10:
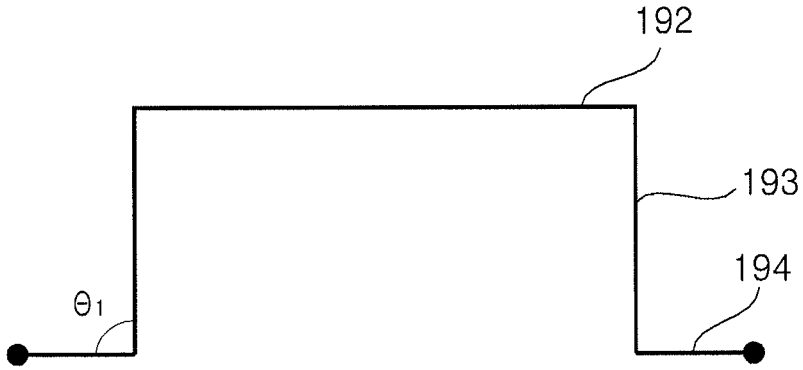
FIG. 10 is a sectional view of the mounting member taken along line X-X of FIG. 7.
Figure 11:
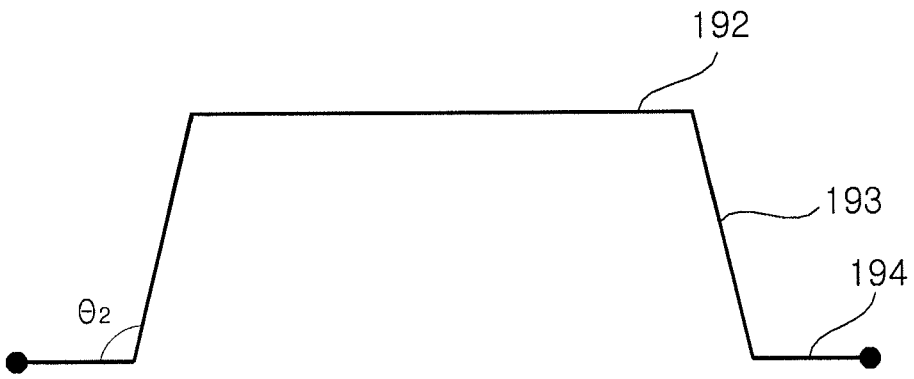
FIG. 11 is a sectional view showing a modified example of the mounting member shown in FIG. 10.
Figure 12:
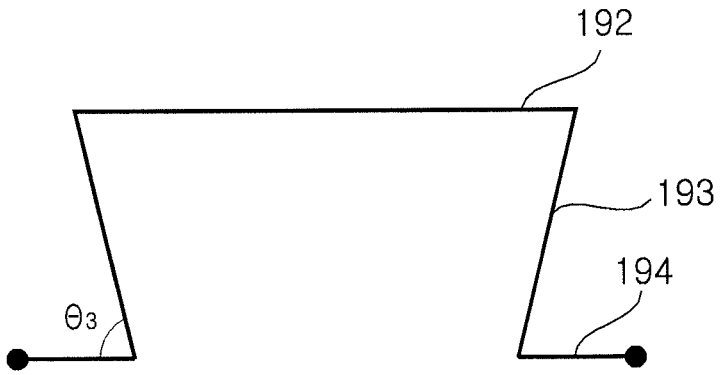
FIG. 12 is a sectional view showing another modified example of the mounting member shown in FIG. 10.

FIG. 10 is a sectional view of the mounting member taken along line X-X of FIG. 7. FIG. 11 is a sectional view showing a modified example of the mounting member 190 shown in FIG. 10. FIG. 12 is a sectional view showing another modified example of the mounting member 190 shown in FIG. 10.

Referring to FIGS. 10 to 12, each of the stator couplers 191 includes a stator clamping portion 192 coupled to the stator, and a connecting portion 193 extending from the stator clamping portion 192. The connecting portion 193 is coupled to the bearing coupler 194. The connecting portion 193 is bent and extends from the stator clamping portion 192 and is then coupled to the bearing coupler 194. That is, the connecting portion 193 is bent from the stator clamping portion 192 and couples the stator clamping portion 192 to the bearing coupler 194. The connecting portion 193 is bent and then coupled to the bearing coupler 194. Each bearing coupler 194 is coupled to each connection portion 193 while forming a specific angle with respect to the connection portion 193. And each stator clamping portion 192 is coupled to each connection portion 193 while forming the specific angle with respect to the connection portion 193. The specific angle $\theta$ may be substantially a right angle $\theta_1$. Alternatively, the specific angle $\theta$ may be substantially an acute angle $\theta_2$. Meanwhile, the specific angle $\theta$ may be substantially an obtuse angle $\theta_3$. As each connection portion 193 forms the specific angle $\theta$ with respect to each stator coupler 192 or each bearing coupler 194, vibration generated from the stator can be removed efficiently while passing through the specific angle $\theta$.

Figure 13:
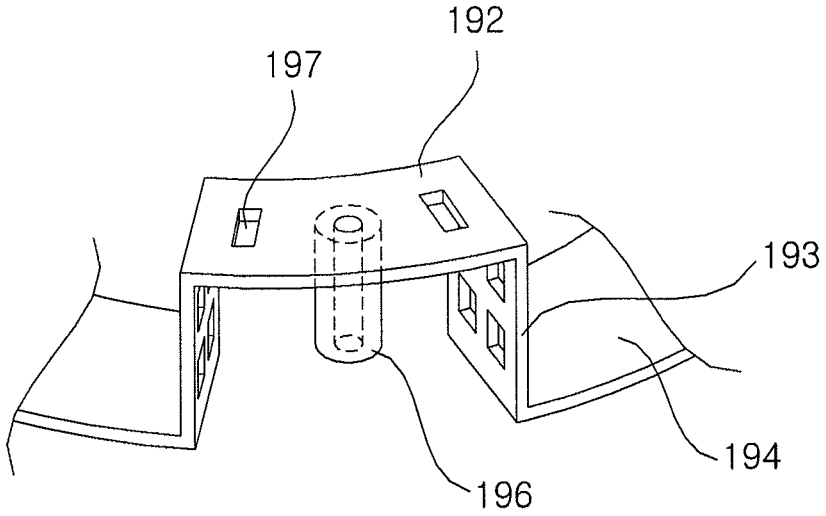
FIG. 13 is a perspective view showing a modified example of stator couplers shown in FIG. 7.

FIG. 13 is a perspective view showing a modified example of the stator couplers 191 shown in FIG. 7. The same reference numbers as those of the above embodiment will be used to refer to the same parts. Differences between the above embodiment and the present embodiment are mainly described below.

Referring to FIG. 13, one or more slots 197 are formed in each stator coupler 191. The one or more slot 197 can also be formed in each connecting portion 193 of the stator coupler 191. The one or more slot 197 can also be formed in each stator clamping portion 192 of the stator coupler 191. Accordingly, when the stator vibrates, the area where the stator clamping portions 192 come in contact with the air while vibrating is widened, so vibration energy can be reduced effectively. As the slots 197 are formed, vibration displacement of the stator clamping portions 192 is increased to thereby reduce vibration energy. Accordingly, the amount of vibration transferred to the connecting portions 193 through the stator clamping portions 192 can be reduced.

Figure 14:
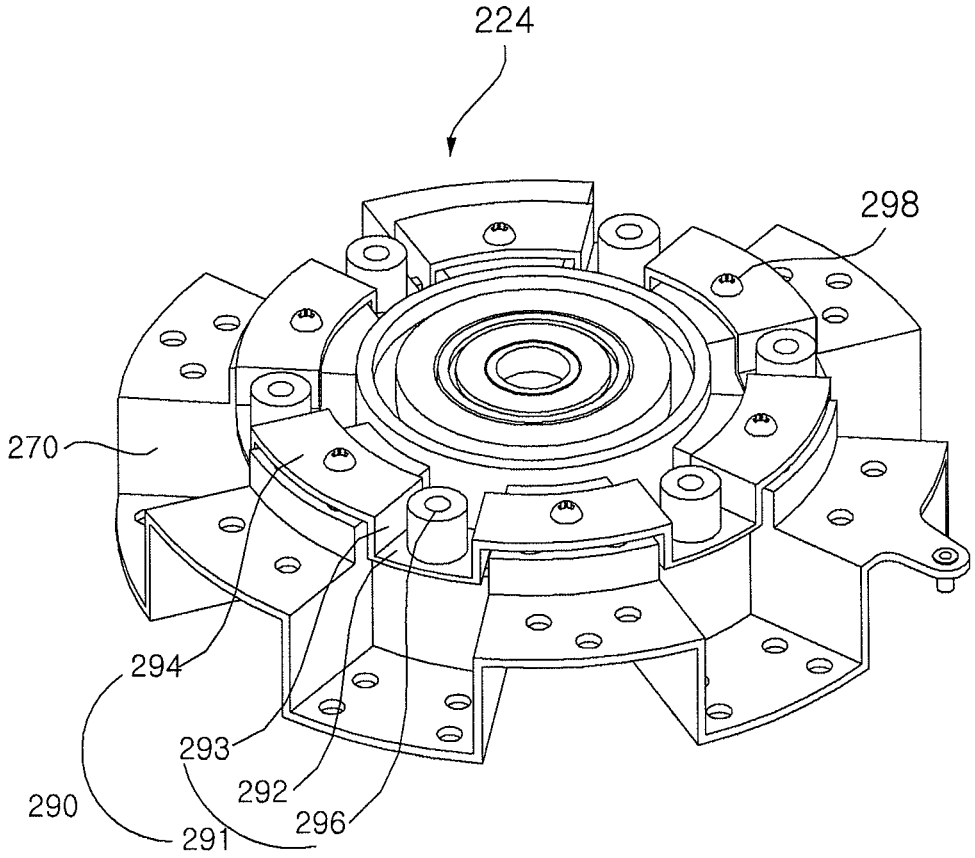
FIG. 14 is a perspective view showing an assembly sequence of a driving unit shown in FIG. 4.
Figure 15:
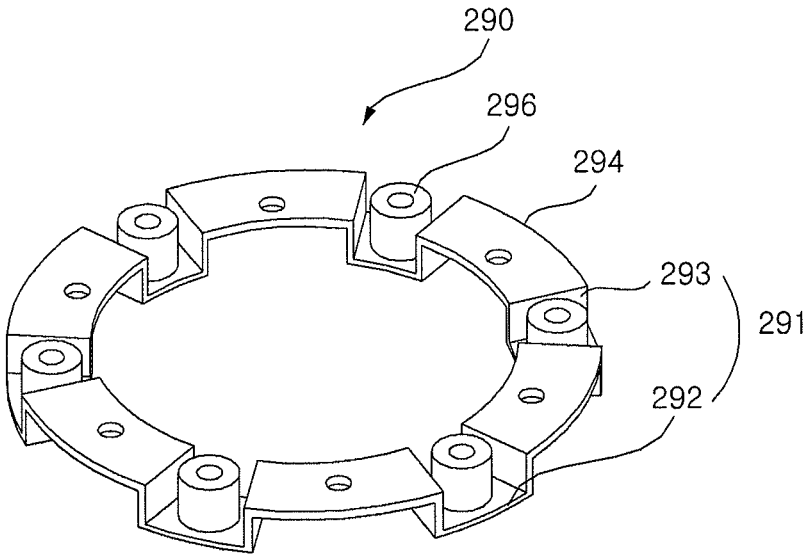
FIG. 15 is a perspective view showing another embodiment of a mounting member shown in FIG. 14.

FIG. 14 is a perspective view showing an assembly sequence of the driving unit 124 shown in FIG. 4. FIG. 15 is a perspective view showing another embodiment of a mounting member 290 shown in FIG. 14. The same reference numbers as those of the above embodiment will be used to refer to the same parts. Differences between the above embodiment and the present embodiment are mainly described below.

Referring to FIGS. 14 and 15, the assembly sequence of a driving unit 224 is the same as or similar to that described with reference to FIGS. 5 and 6. The mounting member 290 includes bearing couplers 294 coupled to a bearing housing 270, and stator couplers 291 disposed between the bearing couplers 294. The stator couplers 291 connect the bearing couplers 294 and clamp a stator (not shown). Each of the stator couplers 291 includes a stator clamping portion 292 coupled to the stator, and a connecting portion 293 extending from the stator clamping portion 292 and then coupled to the bearing coupler 294.

The connecting portion 293 is bent from the stator clamping portion 292. The connecting portion 293 is coupled to the bearing coupler 294 so that the connecting portion 293 is bent from the bearing coupler 294. In other words, the connecting portion 293 is bent from the stator clamping portion 292, so it couples the stator clamping portion 292 to the bearing coupler 294. The connecting portion 293 is coupled to the bearing coupler 294 such that the connecting portion 293 is bent from the bearing coupler 294. Meanwhile, each bearing coupler 294 is coupled to each stator coupler 291 while forming a specific angle with respect to the stator coupler 291. The specific angle may be substantially a right angle.

Meanwhile, the bearing coupler 294 is disposed on a plane different from that of the stator clamping portion 292. That is, the bearing coupler 294 is disposed on a plane higher than that of the stator clamping portions 292. The bearing coupler 294 is disposed on a plane lower than that of the stator clamping portion 292. Since the bearing coupler 294 is disposed on a plane different from that of the stator clamping portion 292, vibration can be reduced effectively. Each of the stator couplers 291 includes a stator clamping portion 292 coupled to the stator, and a connecting portion 293 extending from the stator clamping portion 292. The connecting portion 293 is coupled to the bearing coupler 294. The connecting portion 293 is bent and extends from the stator clamping portion 292 and is then coupled to the bearing coupler 294. That is, the connecting portion 293 is bent from the stator clamping portion 292 and couples the stator clamping portion 292 to the bearing coupler 294. The connecting portion 293 is bent and then coupled to the bearing coupler 294. Meanwhile, each bearing coupler 294 is coupled to each stator coupler 291 while forming a specific angle with respect to the stator coupler 291. The specific angle is not limited to the right angle and may include all angles which can reduce vibration generated from the stator according to experiments, etc.

Clamping holes (not shown) of the bearing couplers 294 are arranged in a first cylindrical direction. Clamping holes (not shown) of the stator couplers 291 are arranged in a second cylindrical direction between the bearing couplers 294. The first cylindrical direction may be substantially the same as the second cylindrical direction. If the first cylindrical direction is identical to the second cylindrical direction as described above, eccentricity of the mounting member 290 due to vibration of the stator can be prevented, so the vibration can be distributed effectively. Hence, the vibration of the stator can be decreased efficiently. Since the vibration is distributed effectively, the malfunction of the washing machine 100 due to breakage, etc. of the mounting member 290 can be prevented.

Figure 16:
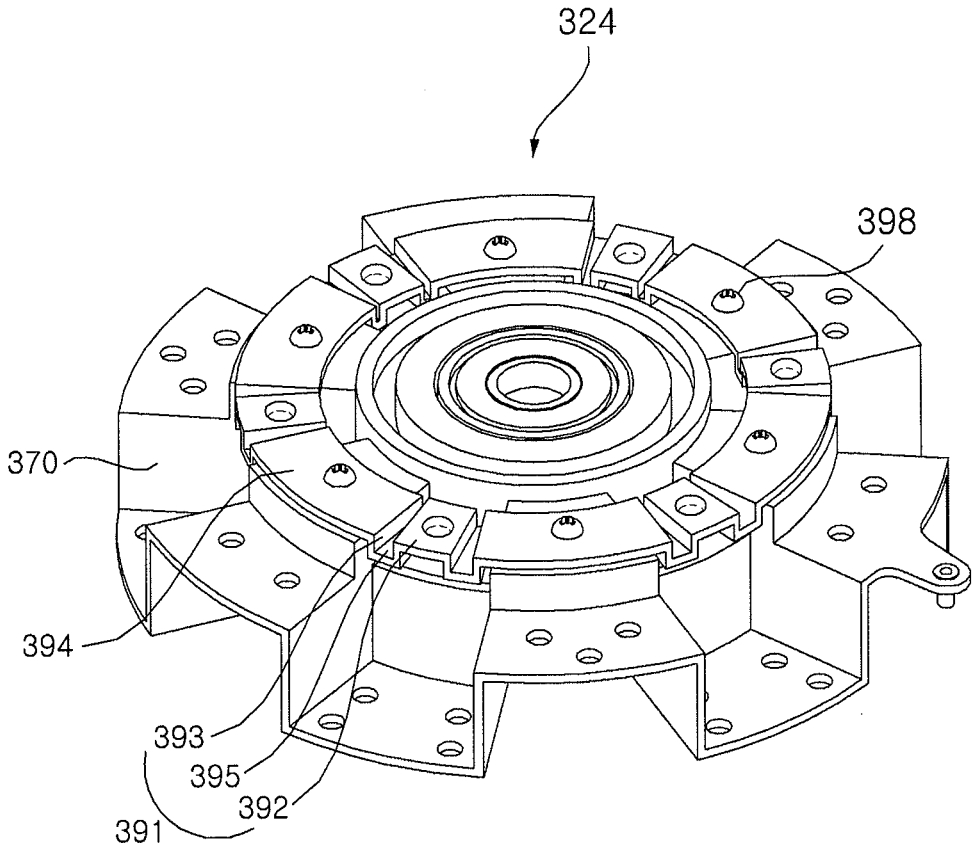
FIG. 16 is a perspective view showing an assembly sequence of a driving unit shown in FIG. 4.
Figure 17:
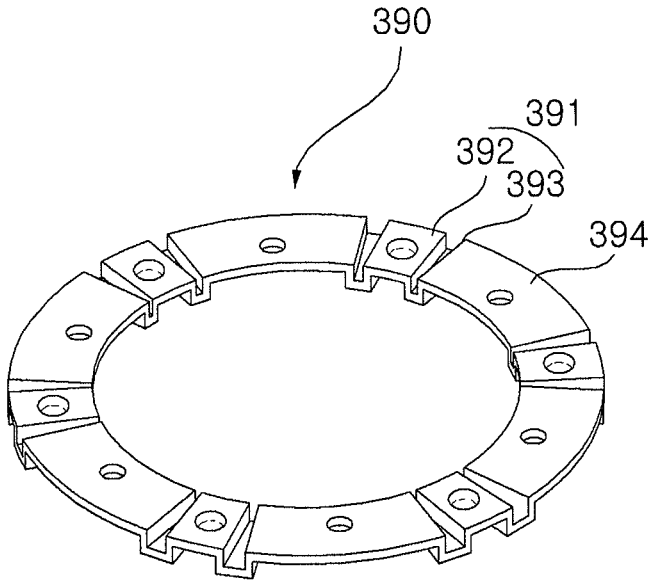
FIG. 17 is a perspective view showing still another embodiment of a mounting member shown in FIG. 14.

FIG. 16 is a perspective view showing an assembly sequence of the driving unit 124 shown in FIG. 4. FIG. 17 is a perspective view showing still another embodiment of a mounting member 390 shown in FIG. 14. The same reference numbers as those of the above embodiment will be used to refer to the same parts. Differences between the above embodiment and the present embodiment are mainly described below.

Referring to FIGS. 16 and 17, the assembly sequence of a driving unit 324 is the same as or similar to that described with reference to FIGS. 5 and 6. The mounting member 390 includes bearing couplers 394 coupled to a bearing housing 370, and stator couplers 391 disposed between the bearing couplers 394. The stator couplers 391 connect the bearing couplers 394 and clamp a stator (not shown). Each of the stator couplers 391 includes a stator clamping portion 392 coupled to the stator, and a connecting portion 393 extending from the stator clamping portion 392 and then coupled to the bearing coupler 394.

The connecting portion 393 is bent from the stator clamping portion 392 and then extends. The connecting portion 393 is coupled to the bearing coupler 394 so that the connecting portion 393 is bent from the bearing coupler 394. In other words, the connecting portion 393 is bent from the stator clamping portion 392, so it couples the stator clamping portion 392 to the bearing coupler 394. The connecting portion 393 is coupled to the bearing coupler 394 so that the connecting portion 393 is bent from the bearing coupler 394. Each of the stator couplers 391 includes a stator clamping portion 392 coupled to the stator, and a connecting portion 393 extending from the stator clamping portion 392. The connecting portion 393 is coupled to the bearing coupler 394. The connecting portion 393 is bent and extends from the stator clamping portion 392 and is then coupled to the bearing coupler 394. That is, the connecting portion 393 is bent from the stator clamping portion 392 and couples the stator clamping portion 392 to the bearing coupler 394. The connecting portion 393 is bent and then coupled to the bearing coupler 394. Meanwhile, each bearing coupler 394 is coupled to each stator coupler 391 while forming a specific angle with respect to the stator coupler 391. The specific angle may be substantially a right angle.

Meanwhile, each stator coupler 391 can further include at least one lead-in portion 395 or protruding portion (not shown) formed on one side of each stator clamping portion 392. The at least one lead-in portion 395 can be included in the connecting portion 393. The at least one lead-in portion 395 can include a plurality of lead-in portions 395. The at least one lead-in portion 395 can be included in the stator clamping portion 392 or the connecting portion 393. The at least one lead-in portion 395 can be bent and formed.

When the number of the at least one lead-in portions 395 is plural, one lead-in portion 395 can be formed at a specific angle with respect to the other lead-in portion (not shown). When each lead-in portion 395 is formed at a specific angle with respect to the other lead-in portion, vibration is transferred in the same manner as or similar to the mounting member 190 described with reference to FIG. 8. In other words, vibration transferred from the stator clamping portions 392 is reduced step by step while passing through the respective lead-in portions 395. Hence, the vibration can be reduced effectively and rapidly, so that vibration transferred to the tub can be reduced.

The at least one lead-in portion 395 can be bent and formed. That is, the at least one lead-in portion 395 is formed on one side of the stator clamping portion 392. One side of the at least one lead-in portion 395 is bent and coupled to one side of the stator clamping portions 392. The other side of the at least one lead-in portion 395 is also bent and coupled to one side of the connecting portions 393. The at least one lead-in portion 395 has been described above, but a description of at least one protruding portion is omitted. However, the description of the at least one protruding portion is the same as or similar to that of the at least one lead-in portion.

Meanwhile, the bearing couplers 394 are disposed on the same plane as that of the stator clamping portions 392. When the at least one lead-in portion 395 is included, the at least one lead-in portion 395 is disposed on a plane lower than that of the bearing couplers 394. However, the stator clamping portions 392 are disposed on a plane lower than that of the at least one lead-in portion 395. Hence, the stator clamping portions 392 are disposed on the same plane as that of the bearing couplers 394. However, the mounting member 390 may be configured so that the bearing couplers 394 and the stator clamping portions 392 are not disposed on the same plane.

In other words, the at least one lead-in portion 395 can be formed stepwise and then disposed on gradually lower planes. The stator clamping portions 392 can be disposed on a lower plane than that of the bearing couplers 394. However, it is to be understood that the at least one lead-in portion 395 may be formed stepwise and then disposed on gradually higher planes and the stator clamping portions 392 may be disposed on a higher plane than that of the bearing couplers 394.

Clamping holes (not shown) of the bearing couplers 394 are arranged in a first cylindrical direction. Clamping holes (not shown) of the stator couplers 391 are arranged in a second cylindrical direction between the bearing couplers 394. The first cylindrical direction may be substantially the same as the second cylindrical direction. If the first cylindrical direction is identical to the second cylindrical direction as described above, eccentricity of the mounting member 390 due to vibration of the stator can be prevented, so the vibration can be distributed effectively. Hence, the vibration of the stator can be decreased efficiently. Since the vibration is distributed effectively, the malfunction of the washing machine 100 due to breakage, etc. of the mounting member 390 can be prevented.

Figure 18:
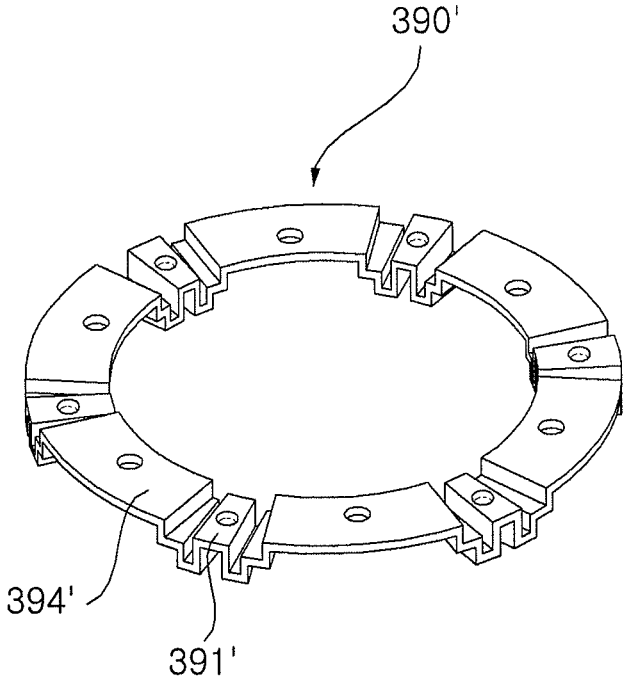
FIG. 18 is a perspective view showing a modified example of the mounting member shown in FIG. 17.

FIG. 18 is a perspective view showing a modified example of the mounting member 390 shown in FIG. 17. The same reference numbers as those of the above embodiment will be used to refer to the same parts. Differences between the above embodiment and the present embodiment are mainly described below.

Referring to FIG. 18, a mounting member 390' includes a clamping portion 394' coupled to the bearing housing (not shown), and a free portion 391' integrally formed from the clamping portion 394'. The clamping portion 394' supports deformation due to a load of the stator (not shown). The free portion 391' accommodates deformation due to a load of the stator and reduces load transferred from the stator to the bearing housing. The free portion 391' is integrally formed with the clamping portion 394'. The free portion 391' extends from the clamping portion 394' so that it includes a bend from the clamping portion 394'. The number of the bends may be plural. The free portion 391' is coupled to the stator. The clamping portion 394' is coupled to the bearing housing.

When the stator vibrates, a load of the stator is transferred to the bearing housing. When the stator vibrates, the free portion 391' also vibrates. Meanwhile, when the free portion 391' vibrates, the clamping portion 394' serves as a fixed end and is fixed to the bearing housing such that the free portion 391' vibrates and is thus deformed by the load of the stator. Thus, since the free portion 391' is deformed, it can partially absorb the load of the stator.

Meanwhile, the clamping portion 394' and the free portion 391' are formed on different planes with them being spaced apart from each other, so the bearing housing and the stator can be prevented from coming in contact with each other. In the prior art, the stator is directly coupled to the bearing housing. Hence, when the stator vibrates, a load of the stator is directly transferred to the bearing housing. However, in the modified example of the present invention, the bearing housing is separated from the stator, so that a load of the stator is transferred through the mounting member 390'.

Further, since the clamping portion 394' and the free portion 391' are formed on different planes with them being spaced apart from each other, the bearing housing is separated from the stator effectively. It is therefore possible to prevent a load of the stator from being transferred to the bearing housing. Accordingly, noise occurring due to vibration of the tub (not shown) can be reduced.

Meanwhile, the mounting member 390' is not limited to the above example, but can have the same or similar structure or effect as that described with reference to FIGS. 1 to 17.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A washing machine, comprising:

a motor including a stator and a rotor;

a drum drivable by a rotation shaft of the rotor;

a tub defining a space where the drum is positioned;

a bearing housing fixed to the tub, the bearing housing including:

a bearing supporting part in which bearings are accommodated, the bearings supporting the rotation shaft of the rotor; and a stator clamping part extending radially outwardly from the bearing supporting part; and a mounting member disposed between the stator and the stator clamping part and configured to reduce vibration transferred from the stator to the bearing housing and the tub, wherein the mounting member is coupled to the stator clamping part, and wherein the stator is mounted on the mounting member.

2. The washing machine of claim 1, wherein the mounting member comprises:

a plurality of bearing couplers coupled to the bearing housing and supporting the mounting member; and a plurality of stator couplers disposed between the bearing couplers and coupled to the stator, wherein the stator couplers interconnect the bearing couplers and fix the stator.

3. The washing machine of claim 2, wherein the plurality of bearing couplers is integrally formed with the plurality of stator couplers.

4. The washing machine of claim 2, wherein each of the stator couplers comprises:

a stator clamping portion coupled to the stator; and connecting portions extending from both ends of the stator clamping portion and coupled to adjacent one of the bearing couplers.

5. The washing machine of claim 4, wherein the connecting portions are bent and extended from the stator clamping portion and are coupled to the bearing couplers so that the connecting portions are bent from the bearing couplers.

6. The washing machine of claim 2, wherein the plurality of bearing couplers and the plurality of stator clamping portions are disposed on different planes.

7. The washing machine of claim 4, wherein each of the bearing couplers is coupled to each of the stator couplers while forming a specific angle between the connecting portions and the bearing couplers.

8. The washing machine of claim 7, wherein each of the bearing couplers is coupled to each of the stator couplers while forming substantially a right angle between the connecting portions and the bearing couplers.

9. The washing machine of claim 2, further comprising:

first clamping holes arranged in the plurality of bearing couplers, the first clamping holes being arranged in a first cylindrical direction; and seconding clamping holes arranged in the plurality of stator couplers, the second clamping holes being arranged between the bearing couplers in a second cylindrical direction.

10. The washing machine of claim 9, wherein the first cylindrical direction is substantially identical to the second cylindrical direction.

11. The washing machine of claim 2, wherein the plurality of stator couplers and the plurality of bearing coupler are spaced apart from each other at regular intervals.

12. The washing machine of claim 2, wherein the plurality of stator couplers include bosses extending from the stator couplers up to the same plane as that of the bearing couplers.

13. A washing machine, comprising:

a motor including a stator and a rotor, the stator having a front side;

a drum drivable by the rotor;

a tub defining a space where the drum is positioned, the tub having a rear side; and a mounting member formed separately from the tub and disposed between the front side of the stator and the rear side of the tub, wherein the mounting member permits relative rotational movement between the tub and the stator, and wherein the tub includes a bearing housing, wherein the mounting member is spaced from the bearing housing in an axial direction of the rotor, and wherein the mounting member comprises:

a clamping portion coupled to the bearing housing; and a free portion integrally formed with the clamping portion and reducing vibration transferred from the stator to the bearing housing.

14. The washing machine of claim 13, wherein the clamping portion and the free portion are formed on different planes spaced apart from each other, thus preventing the bearing housing and the stator from coming in contact with each other.

15. A washing machine, comprising:

a motor including a stator and a rotor;

a drum drivable by a rotation shaft of the rotor;

a tub defining a space where the drum is positioned;

a bearing housing fixed to the tub, the bearing housing including:

a bearing supporting part in which bearings are accommodated, the bearings supporting the rotation shaft of the rotor; and a stator clamping part extending radially outwardly from the bearing supporting part; and a mounting ring sandwiched between the stator and the stator clamping part and coupled to the stator clamping part to mount the stator on the mounting ring.

16. The washing machine of claim 15, wherein the mounting ring comprises:

a plurality of bearing couplers coupled to the bearing housing; and a plurality of stator couplers disposed between the bearing couplers and connecting the bearing couplers, the stator couplers being coupled to the stator.

17. The washing machine of claim 16, wherein the plurality of stator couplers are bent from the plurality of bearing couplers and integrally formed with the bearing couplers.

18. The washing machine of claim 16, wherein the plurality of stator couplers comprises bosses extending from the stator couplers up to the same plane as that of the bearing couplers.

19. A laundry machine, comprising:

a motor including a stator and a rotor;

a drum drivable by rotation of the rotor;

a bearing housing supporting the stator;

a mounting ring having a first surface and a second surface opposite the first surface, the first surface contacting the stator and the second surface contacting the bearing housing, the mounting ring coupled to the bearing housing to mount the stator on the mounting ring: and fasteners extending through the stator and mounting ring and secured to the bearing housing.

* * * * *